United States Patent [19]

Bell et al.

[11] Patent Number: 5,048,603

[45] Date of Patent: Sep. 17, 1991

[54] LUBRICATOR CORROSION INHIBITOR TREATMENT

[76] Inventors: Larry M. Bell, 106 Conley Pl., Odessa, Tex. 79762; Charles L. Coskrey, 1411 Glenwood, Odessa, Tex. 79761

[21] Appl. No.: 529,811

[22] Filed: May 29, 1990

[51] Int. Cl.[5] ..... E21B 33/08

[52] U.S. Cl. ..... 166/70; 166/82; 166/84; 166/902

[58] Field of Search ..... 166/70, 304, 81, 82, 166/84, 88, 902, 83, 86, 87

[56] References Cited

U.S. PATENT DOCUMENTS

| | | | |
|---|---|---|---|
| 1,369,913 | 3/1921 | Brunhoff . | |
| 1,521,390 | 12/1924 | Reynolds . | |
| 2,522,444 | 9/1950 | Grable | 166/16 |
| 2,677,427 | 5/1954 | McKinney et al. | 166/14 |
| 2,748,870 | 6/1956 | Basham et al. | 166/77 |
| 2,943,682 | 7/1960 | Ingram, Jr. et al. | 166/77 |
| 3,032,112 | 5/1962 | Webster | 166/84 |
| 3,145,995 | 8/1964 | Adamson et al. | 277/28 |
| 3,212,581 | 10/1965 | Marshall | 166/84 |
| 3,500,907 | 3/1970 | Gentry | 166/70 |
| 3,532,163 | 10/1970 | Ecuer | 166/53 |
| 3,637,009 | 1/1972 | James | 166.5/77 |
| 4,090,573 | 5/1978 | Rankin | 175/45 |
| 4,494,607 | 1/1985 | Ford et al. | 166/902 |
| 4,895,205 | 1/1990 | Thompson et al. | 166/82 |

OTHER PUBLICATIONS

Guiberson (Dresser), Catalog for "Swabbing Accessories" (p. 23).

Guiberson (Dresser), Catalog for "Swabbing Accessories" (no page number).

*Primary Examiner*—Terry L. Melius

*Attorney, Agent, or Firm*—Marcus L. Bates

[57] ABSTRACT

Apparatus for running tools suspended from a wireline into a wellbore under pressure, while simultaneously cleaning and treating the wireline with treatment fluid to inhibit the wireline against corrosion. A lubricator barrel and a cylinder is connected to the upper end of a wellbore and a wireline extends through the axial centerline of the barrel. Several packet devices are arranged for squeezing and surrounding a length of the wireline to strip liquid and debris from the outer surface thereof. Spacers keep the packer devices arranged in axially spaced relationship within the cylinder and form a treatment chamber between adjacent packers and a cleaning chamber between other adjacent packers. A pressure differential is applied across a ram device which reciprocates within the cylinder and this compresses each packer device simultaneously. A pump is connected to actuate the ram device and set the packet devices. The treatment chamber receives treatment chemical that is pumped thereinto for inhibiting the wireline. Residual treatment chemical is discharged from the cleaning chamber.

20 Claims, 2 Drawing Sheets

LUBRICATOR CORROSION INHIBITOR TREATMENT

REFERENCE TO LIMITED DISCLOSURE DOCUMENT

Reference is made to Limited Disclosure Document, Ser. No. 229,738 filed June 20, 1989.

BACKGROUND OF THE INVENTION

Apparatus for running tools suspended from a wireline into and out of hydrocarbon producing wells under high pressure is known to those skilled in the art, as evidenced by the patents to Attison et al U.S. Pat. No. 3,145,995; Gentry U.S. Pat. No. 3,500,907; Marshal U.S. Pat. No. 3,212,581; Ingram, Jr. et al U.S. Pat. No. 2,943,082; and Basham et al U.S. Pat. No. 2,740,070. It is known to wash tubular goods going into and coming out of a borehole as shown by Reynolds U.S. Pat. No. 1,521,390. Ford et al U.S. Pat. No. 4,494,609 cleans and inhibits sucker rod against corrosion as the rod string is being withdrawn from the borehole. Reference is made to the above prior art for further background of the present invention, a comprehension of which is necessary in order to fully appreciate this disclosure.

A wireline is introduced into a borehole in order to run a tool string downhole, and it is often desirable to communicate the tool string with above surface equipment. The wireline often comprises a multi-stranded metallic member about the diameter of a pencil, and it is desirable to maintain a single length of wire wherever possible because of the complexities involved in introducing and retrieving the wireline from the borehole. The borehole usually is under great pressure and for this reason, it is advantageous to clean and inhibit the wireline as it is initially forced into the borehole under pressure; and thereafter to again clean and again inhibit the wireline as it is retrieved from the borehole. The process of cleaning and treating the wireline with a chemical inhibitor impregnates the wireline with the inhibitor, or treatment chemical, and elongates the expected life of the wireline. Method and apparatus for achieving the above desirable goals is the subject of the present invention.

SUMMARY OF THE INVENTION

This invention comprehends both method and apparatus for cleaning and treating a wireline while it is run into and out of a wellbore under pressure. The apparatus of this invention comprises a special treatment cylinder attached at the upper end of a lubricator barrel while the lower end of the lubricator barrel is attached to a wellhead in axially aligned relationship therewith. The apparatus of the present invention is completely assembled after the wireline has been extended axially therethrough.

The apparatus includes a plurality of spaced elastomeric packer devices coaxially arranged within the treatment cylinder for squeezingly surrounding a length of the wireline. Spacer means are arranged axially between the packer devices and maintain the packers properly spaced apart to thereby form spaced apart chambers. The spacer means also transfers compressive force into opposed ends of the packer devices to thereby control the magnitude of the sealing force exerted against the exterior surface of the wireline.

A ram means is reciprocatingly received at the lower end of the treatment cylinder for exerting compressive forces against the opposed ends of the packer devices, and thereby concurrently compress the packer devices and achieve the desired sealing force against the wireline, and against the interior of the cylinder.

The spaced chambers include an upper chamber connected to a source of inhibitor chemical which is transferred thereinto under a predetermined pressure in order to fill the chamber with inhibitor chemicals through which the wireline axially extends. There is also a lower chamber for cleaning the residual treatment chemical from the outer surface of the wireline as the tool string is going into the borehole, and which also cleans debris and well fluids from the surface of the wireline as the tool string is being retrieved on its return trip from the borehole.

Accordingly, there is an upper elastomeric packer device that cleans the wireline of debris as the wireline is going into the hole. Next, the wireline passed through the chemical treatment chamber where it is impregnated with inhibitor treatment chemical. A middle or central packer device separates the treatment chamber from a cleaning chamber and further squeezes excess chemicals from the wireline as the wireline exits the treatment chemical chamber and enters the cleaning chamber. The wireline continues through the cleaning chamber where the lower packer device squeezes and wipes the surface of the wireline, with any removed treatment chemical remaining within the cleaning chamber where it is free to exit the upper cylinder. The wireline exits the lower packer and continues downhole into the borehole, carrying therewith a coating and an impregnation of the treatment chemical.

In one form of the invention, the elastomeric packer devices are sealingly received within a cylinder having diminishing inside diameter marginal lengths that are reduced in size in an upward direction. As the ram means simultaneously compress all of the packer devices, the uppermost packer device is first set, followed by the second packer device, followed by the third packer device. This provides the unforeseen advantage of sequentially setting the packers from the top to the bottom of the treatment cylinder so that the sealing pressure exerted by the packers against the wireline is greatest at the upper end of the treatment cylinder where the pressure differential across the apparatus is reduced to atmospheric pressure on the upper end thereof.

In another embodiment of the invention, the treatment cylinder is tapered to decrease the diameter thereof in an upward direction. The cylinder receives the packers therein such that the upper packer is positioned within a relatively small diameter marginal length of the cylinder, the middle packer is positioned within a medium size diameter part of the cylinder, while the lower packer is positioned within a relatively large diameter marginal length of the cylinder.

Accordingly, a primary object of the present invention is the provision of method and apparatus for cleaning and inhibiting a wireline while running tools suspended therefrom into a wellbore under pressure.

Another object of the present invention is the provision of method and apparatus by which a wireline coming out of a wellbore under pressure is simultaneously cleaned and treated, whereby the wireline can be safely stored in treated condition until it is again needed.

A still further object of the present invention is the provision of a lubricator having a treatment cylinder at the upper end thereof that includes spaced apart elastomeric packers therein that form a chemical treatment chamber and a cleaning chamber that cleans and inhibits a wireline as it is run into a borehole; and, which cleans and inhibits the wireline as it is removed from the borehole.

Another and still further object of the present invention is the provision of an improved lubricator apparatus having an upper treatment cylinder and a lubricator lower barrel, wherein the upper treatment cylinder contains packers for enabling a wireline to be introduced into a wellbore under pressure, while the lubricator barrel underlies the upper cylinder and enables a tool package to be introduced into the wellbore under pressure.

An additional object of this invention is the provision of an improved inhibitor and lubricator apparatus for introducing wirelines into a borehole, said apparatus having a combination treatment and packer cylinder within which there are adjacent marginal lengths thereof made of diminishing diameters in an upward direction within which a plurality of wireline engaging elastomeric packer devices are located.

A still further object of this invention is the provision of a combination lubricator and inhibitor device wherein the inhibitor device has a cylinder which is tapered, whereby the diameter of the chambers that contain the packers diminish in an upward direction and thereby sequentially set the packers in an upward direction.

Another and further object of the present invention is the provision of both method and apparatus for running tools suspended from a wireline into a wellbore under pressure by the provision of a plurality of packer devices spaced apart from one another to form a treatment chamber and a cleaning chamber, and wherein the wireline is cleaned of fluids prior to being introduced into the treatment chamber, and where the wireline is impregnated with inhibitor and subsequently passes through a cleaning chamber where residual inhibitor is removed as the wireline continues through a lower packer device and into the wellbore under pressure.

An additional object of the present invention is the provision of a method wherein a wireline is cleaned of well fluids as it exits a wellbore under pressure and travels through a cleaning chamber where residual well fluid is removed from the surface thereof, and travels through a treatment chamber where it is impregnated with treatment chemical, and thereafter is stored until again needed.

The above objects are attained in accordance with the present invention by the provision of a method for use with apparatus fabricated in a manner substantially as described herein.

These and various other objects and advantages of the invention will become readily apparent to those skilled in the art upon reading the following detailed description and claims and by referring to the accompanying drawings.

DETAILED DESCRIPTION OF THE PREFERRED EMBODIMENTS

Figure 1:
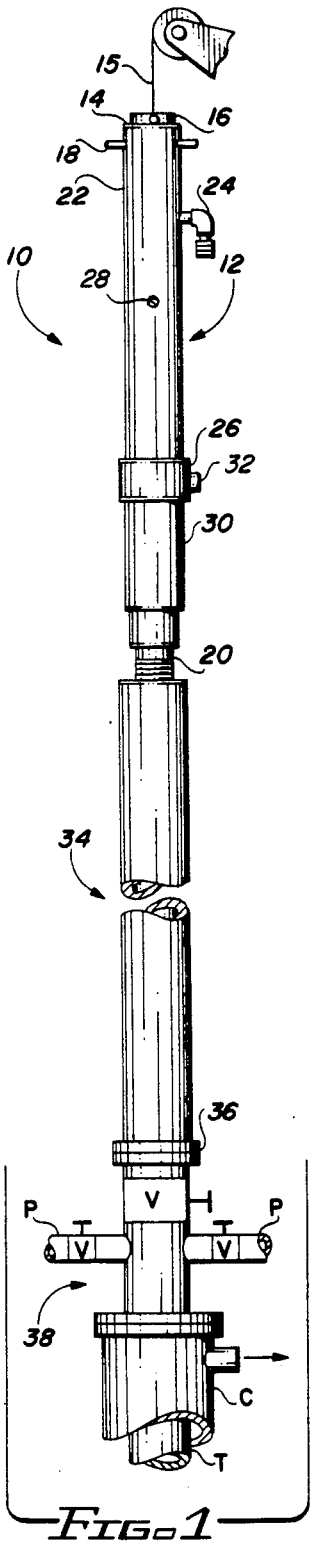
FIG. 1 is a broken, fragmentary, side elevational view of apparatus made in accordance with the present invention.

FIG. 1 of the drawings discloses the combination 10 of the present invention, and includes an upper treatment cylinder 12 having an upper end 14 through which a wireline 15 axially extends therethrough. A gate 16 is removably attached to the upper end of cylinder 12 by a fastener means in the form of a U-shaped pin 18. The gate forms an apertured, slotted, closure member at the upper end of the upper cylinder 12. The lower end 20 of the upper cylinder 12 is opposed to the upper end 14 thereof. Treatment chemical inlet 24 is positioned near the upper marginal end 22 of the cylinder 12. Coupling 20 underlies outlet 28. The coupling 26 is provided with flow port 32 for reasons which will be more fully appreciated later on. The coupling is attached to a lower ram assembly 30, which can be considered a part of the cylinder 12. The lower ram assembly 30 includes a passageway connected to receive flow from flow port 32 of the coupling 26 to which a source of pressurized fluid can be attached.

The lower end 20 of the lower ram assembly 30 is removably affixed to the upper end of a prior art lubricator barrel 34, which can take on any number of different forms. The lower end of lubricator barrel 34 is attached at 30 to a prior art wellhead 38. The wellhead 38 has the usual valves V attached to the illustrated pipes P, and further includes a casing C and tubing T. The tubing T extends downhole in the usual manner and communicates with lubricator barrel 34.

Figure 3:
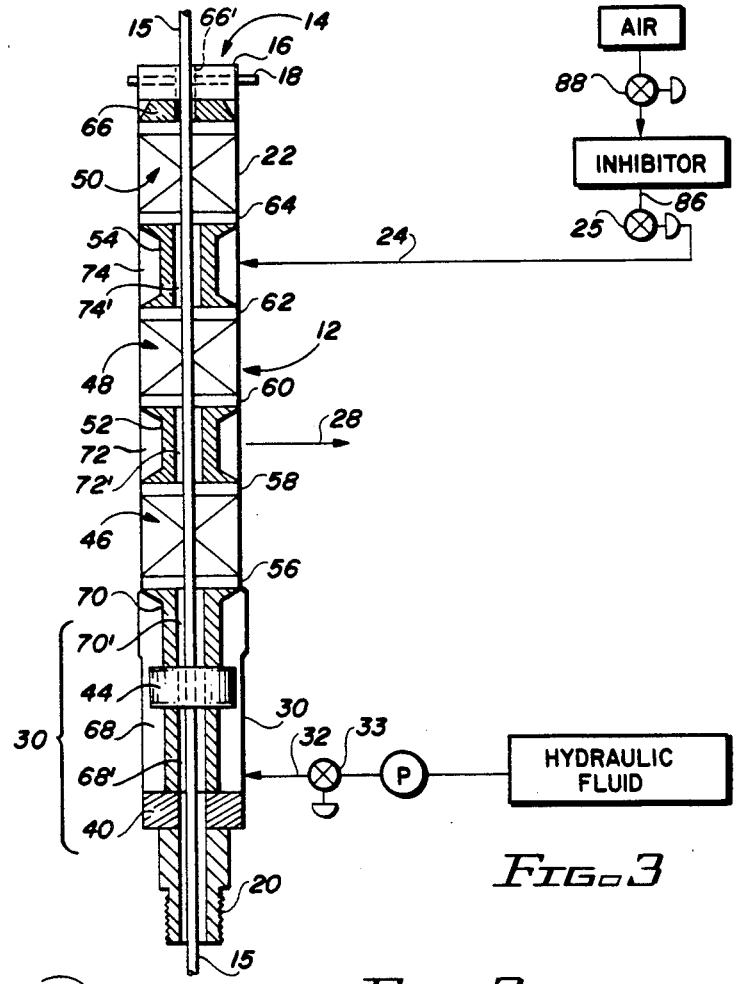
FIG. 3 is a part diagrammatical, part schematical, part cross-sectional, side view that sets forth the method of the present invention.
Figure 4:
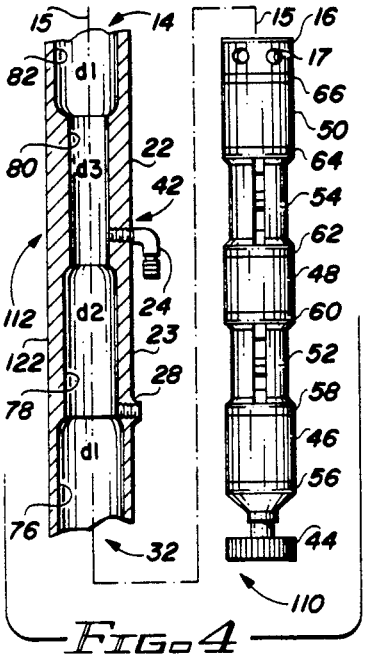
FIG. 4 is a partly disassembled view of part of the apparatus seen in the foregoing Figures, with some parts being shown in cross-section and some parts being broken away therefrom.
Figure 6:
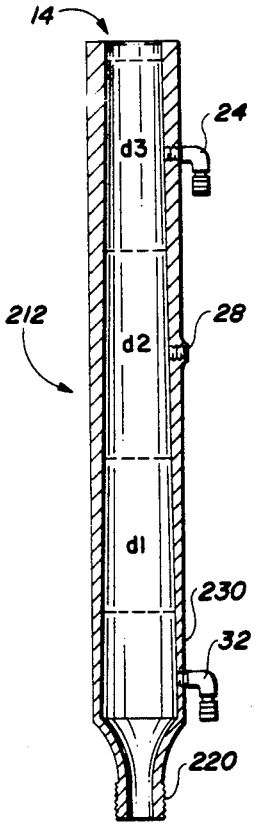
FIG. 6 is a longitudinal, cross-sectional view of part of the apparatus disclosed in some of the foregoing figures and which sets forth a modification of the present invention.
Figure 5:
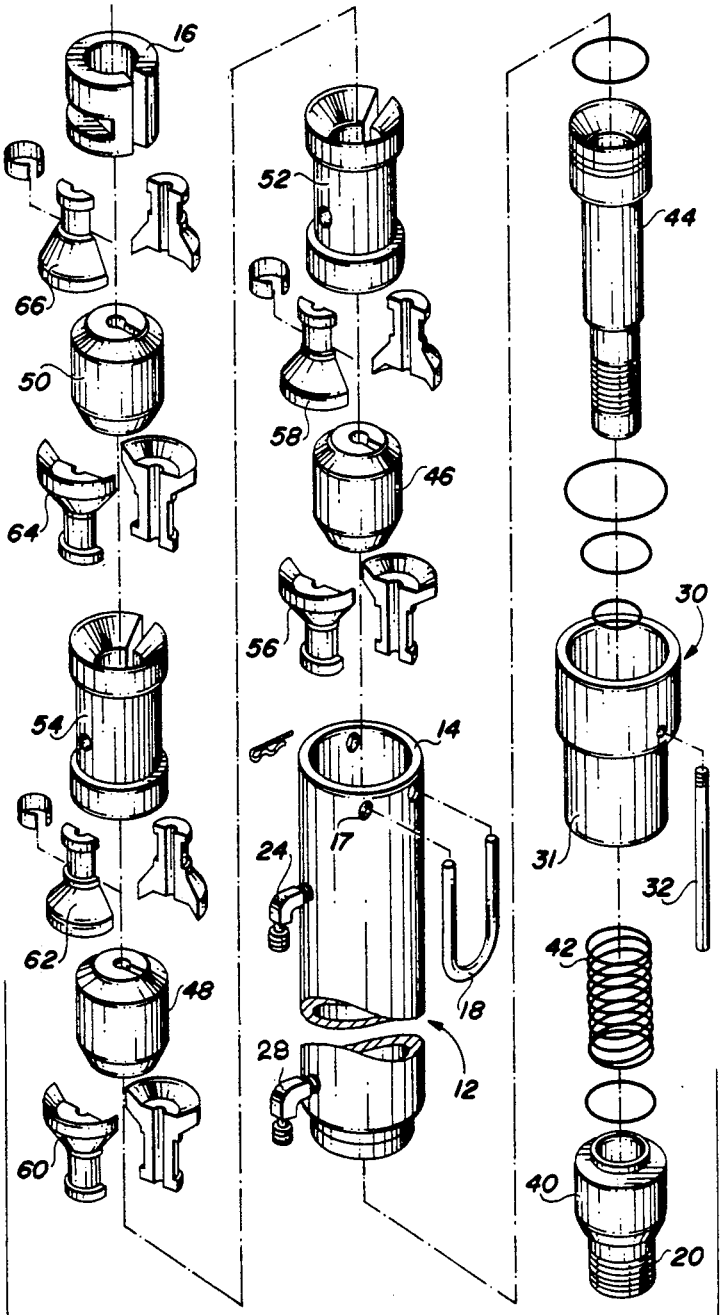
FIG. 5 is an exploded view of part of the apparatus disclosed in FIG. 1.

Looking now to the schematical representation of FIG. 3 together with the details of FIGS. 4 and 5, it will be noted that the ram assembly 30 includes a base 40, spring 42, and a ram means in the form of annular ram piston 44. The ram piston 44 is connected to engage a lowermost spacer 52 which in turn is positioned to engage the lower face of an elastomeric lower packer device 46.

There is also a middle elastomeric packer device 48 and an upper elastomeric packer device 50 spared from one another by means of a lower spacer 52 and an upper spacer 54. Moreover, the spacers and packer devices have conical bushings and clips which present conical faces against which the conical faces of the packer devices is received. There is a lower and an upper conical bushing and clip 56 and 58 for lower packer device 46; a lower and upper conical bushing and clip 60 and 62 for middle packer device 48; and a lower and upper conical bushing and clip 64 and 66 for upper packer device 50. The packer devices each are discontinuous, there being a radial split therein which can be forced open in order to accommodate placement of the wireline into the central passage thereof, after the wireline has been introduced into the cylinder 12 and lubricator barrel 34. Similarly, the conical bushings are each made in halves and clipped together for enclosing the wireline loosely therewithin.

The spacers each have a radial slot formed longitudinally through the annular sidewall thereof. This enables all of the packer devices, spacers, and conical bushings and clips to be assembled about the wireline while the wireline is extending through cylinder 12 and lubricator barrel 34, as is known by those skilled in the art. It is therefore apparent that cylinder 12 together with the packer devices contained therein provides a combination upper treatment cylinder as well as a packer device for the apparatus of the present invention.

As seen in FIG. 3, together with other figures of the drawings, there is an annular working chamber 68 formed within the ram assembly which serves as an annular variable chamber into which hydraulic fluid is forced from pump P, through power valve 33, and into or from flow port 32 located below ram piston 44, thereby driving ram piston 44 in a reciprocating manner uphole or downhole, and thereby compressing simultaneously all of the spaced apart packer devices 46, 48 and 50, as will be more fully discussed later on herein. Hence, the annular ram piston 44 divides the annular ram working chamber into a lower annular working chamber 68 and an upper annular working chamber 70. Numeral 68' indicates a passageway which extends from the prior art lubricator barrel 34 up through the central passageway of the treatment apparatus through which wireline 15 freely traverses when packer devices 46, 48 and 50 are relaxed.

There is an annular cleaning chamber 72 that includes axial chamber 72'. The cleaning chamber 72 is formed between the spaced apart packer devices 46, and 48, with lower spacer 52 maintaining conical bushings 58 and 60 in spaced apart relationship and in abutting engagement with the two confronting packer devices 46 and 48.

Annular treatment chamber 74 is formed between packer devices 48 and 50, with there being the before mentioned upper spacer 54 having opposed ends that receive the before mentioned conical bushings 62, 64 in seated relationship therewith, with the opposed faces of the conical bushings 62, 64 bearing against the confronting conical faces of packer devices 48 and 50. The treatment chamber 74 communicates with axial chamber 74', all of which is isolated by packer devices 48 and 50, and communicates with the inhibitor supply through treatment chemical inlet 24.

Conical bushing 66 receives the upper conical face of upper packer device 50 and is seated within the before mentioned gate 16. Hence, gate 16 is removably affixed to upper end 14 of treatment cylinder 12 by fastener means 18 and receives bushing 66 in abutting engagement therewith, while the opposed end of conical bushing 66 abuttingly engages the uppermost packer device 50. At the same time, the lowermost packer device 46 similarly abuttingly engages conical bushing 56 which is reciprocated in response to reciprocation of ram piston 44.

In the embodiment set fort in FIG. 4, the treatment cylinder 112 is seem to have a plurality of chambers formed therein, with there being a lowermost chamber 75 having a relatively large diameter d1, an intermediate smaller medium size chamber 78 having a diameter d2, and an upper smallest chamber 80 having a diameter d3. Chamber 82 is equal in size to chamber 76 for convenience. The diameters d1, d2, d3, respectively, may be 2.5 inches, 2.4 inches, and 2.3 inches, for example only the illustrated relative diameters d2, d3 are exaggerated for illustrative purposes.

Still referring to FIG. 4, note that gate 16 has apertures 17 formed therein through which fastener pin 18 extends. The packer devices 46, 48 and 50 are equal in diameter and are of a size to be received within chambers 76, 78 and 80. The upper chamber 82 is located below the upper end of the cylinder that receives gate 16 therein.

Figure 2:
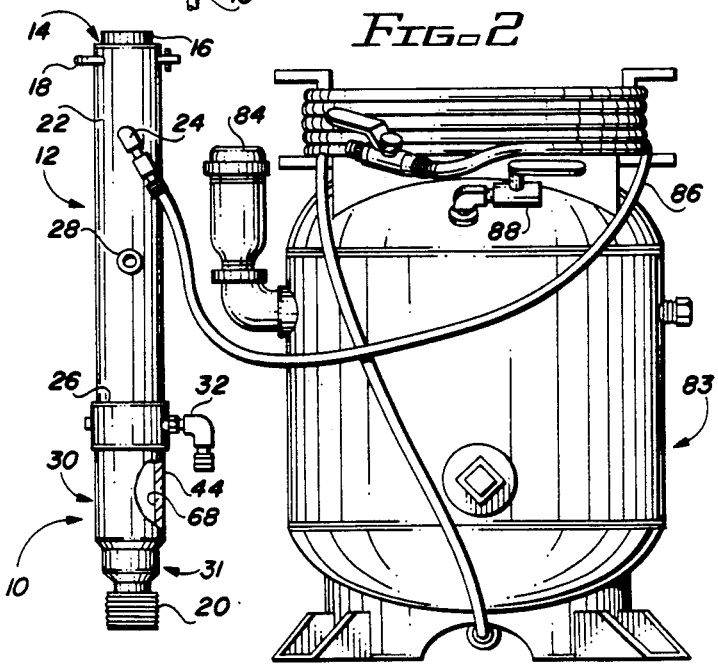
FIG. 2 is a side elevational view showing the apparatus of the present invention.

In FIG. 2, a cap 84 forms a closure member for the inlet into the inhibitor vessel 83. Flow line 86 interconnects the treatment chemical contained within vessel 83 with the annulus or treatment chamber 74 by means of inlet 24. Control valve 25 of FIG. 3 maintains the pressure within annulus 74 at a preset desired pressure differential. Air inlet valve 88 provides the magnitude of pressure desired upstream of control valve 25.

In operation, the prior art lubricator barrel 34 is attached to a wellhead in the illustrated position of FIG. 1, the wireline 15 is extended through cylinder 12 and ram assembly 30 and attached to a tool string (not shown). The tool string is lowered into the lubricator barrel 34 with the lubricator valve V in the closed position. The upper cylinder 12 and ram assembly 30 are assembled and are attached to the lubricator barrel 34, so the wireline 15 extends axially therethrough the bushings, packer devices and bushing spacers are assembled about the wireline and dropped into the upper cylinder 12, and thereafter the gate 16 is locked into place by fastener pin 18. The inhibitor container 83 is pressurized and connected to the treatment chemical inlet 24 while a suitable outlet conduit is attached at discharge outlet 28. A high pressure pump P connects a source of hydraulic fluid through valve 33 to flow port 32. The pump P is actuated until the desired pressure is effected on the ram means or piston 44 in order to achieve a suitable seal between the wireline and the packer devices.

As the pressure differential across ram means 44 is increased at valve 33, the resilient packer devices 46, 48 and 50 are compressed between conical bushings 56 and 66; or, between ram piston 44 and gate 16. The packer devices are sequentially set beginning at the top and proceeding toward the bottom due to the upwardly diminishing diameter of the working chambers within which each of the resilient packer devices are located. The packer devices 46, 48 and 60 preferably are of equal diameters, and accordingly, upper packer device 50 will set in chamber d3 before middle packer device 48 expands into sealed engagement with the wall of chamber d2 which will set prior to lower packer device 40 expanding into engagement with the wall of chamber d1. This unusual configuration improves the seal and life of the rubber packers, and provides a pressure gradient that increases in an upward direction. Moreover, such a new combination has the unexpected advantage of the packer devices being forced into greater sealed relationship respective to cylinder 12 in response to increased well pressure.

Annular inhibitor chamber 74 is completely filled with inhibitor treatment fluid prior to the final setting of the packer devices. The wireline 15 is well protected and in a clean condition as it comes off the spool and enters the upper treatment cylinder 12. Any residual material on the surface of wireline 15 will be removed by upper packer device 50 prior to the wireline traveling through chamber 74'. As the wireline travels from atmospheric conditions and through upper packer device 50, most of the air is squeezed therefrom and the surface thereof usually retains sufficient inhibitor from previous treatment to serve as a lubricant as the wireline travels through the upper packer device 50. As the wireline travels through chamber 74', new treatment chemical is forced into the small voids of the wireline, thereby intimately coating all of the exposed outer surfaces of the wireline which are available to the pressurized treatment chemical at 74, 74'. The wireline continues through the middle packer 48 with very little surplus chemical being carried therewith, and then continues into axial chamber 72'. Any residual material removed by lower packer device 46 accumulates within axial chamber 72' and is free to exit through outlet 28. The wireline continues through the spacer and axially through the hollow ram assembly 30, down through the lubricator barrel 34, through the wellhead 38 where it extends into the well tubing and continues downhole into the borehole for perhaps 10 to 20 thousand feet below the ground where the tool string achieves whatever its desired purpose may be.

Impregnation of the wireline with inhibitor material as it travels downhole offers immediate protection against the corrosive effects of the downhole fluids. Some well fluids contain acids because the well has undergone an acidizing treatment; and, some well fluids inherently contain highly corrosive material such as hydrogen sulfide, salt water, and other deleterious liquids and gases.

As the wireline is retrieved from the borehole the lower packer device 46 squeezes and removes most of the contaminants from the surface of the wireline, and the removed material falls back down through the axial passageway 70', 68' and down the borehole. The centrally located middle packer 48 removes additional contaminants and well fluids from the traveling wireline, and this removed material accumulates within chambers 72, 72' and is free to exit at outlet 28. Hence, the wireline has been twice cleaned by series arranged packer devices before it enters into the treatment chamber 74, 74' where the inhibitor is again forced into the voids of the wireline, with the surplus inhibitor being stripped by the upper packer device 50 as the wireline is spooled back onto the wireline drum (not shown).

Impregnation of the wireline with treatment chemical during storage elongates the life of the wireline and protects it from atmospheric corrosion. It is considered within the comprehension of this invention to select the proper treatment chemical that will provide the desired corrosion protection in accordance with known downhole fluids. Stated differently, the reservoir engineer usually will know the chemical composition of the well fluids and he will order the appropriate inhibitor treatment chemical from the chemical company in order to provide the wireline with maximum corrosion protection as it is run into and back out of the borehole.

I claim:

1. Apparatus for simultaneously cleaning and treating a wireline with treatment fluid to reduce the rate of corrosion thereof, while running tools suspended from the wireline through a wellhead and into a wellbore under pressure, comprising, in combination:

a lubricator, an upper cylinder, and a ram assembly coaxially aligned with respect to one another; said ram assembly, said upper cylinder, and said lubricator each have an upper end opposed to a lower end thereof, said ram assemble is connected to the lower end of the upper cylinder and the lower end of the ram assembly is connected to the upper end of the lubricator; the lubricator has a lower end that can be connected to a wellhead; a passageway extends axially through the lubricator, ram assembly, and upper cylinder in axially aligned relationship with respect to a wellbore to which said lubricator may be attached and through which a wireline can extend;

a plurality of spaced packer devices located within said upper cylinder for sealingly engaging and squeezingly surrounding a length of the wireline and thereby strip liquid therefrom as the wireline travels therethrough; spacer means by which said packer devices are arranged in axially spaced relationship respective to one another and within said upper cylinder; said packer devices cooperate together to form a high pressure treatment chamber that is isolated from ambient between adjacent packer devices, and a cleaning chamber between other adjacent packer devices; whereby said treatment chamber is spaced from said cleaning chamber by a packer device; means for filling said treatment chamber with treatment fluid; drain means for discharging fluid from said cleaning chamber;

said ram assembly includes a ram cylinder, a ram means reciprocatingly received within said ram cylinder for axial movement in response to pressure differential thereacross, means by which a flow of fluid is effected in said ram cylinder at a location for actuating said ram means with fluid pressure; said ram means simultaneously engages and axially compresses each packer device and thereby sealingly engage the wireline when pressure is effected across said ram means;

whereby a wireline can be cleaned and inhibited with treatment fluid as it is run into the wellbore, and can be cleaned and inhibited as it is retrieved from the wellbore.

2. The combination of claim 1 wherein said packer devices have opposed conical faces engaged with conical members, said spacers have opposed ends within which said conical members are seated, whereby the ram means urges the opposed conical members towards one another and thereby compresses the packer devices to cause the packer devices to be squeezed against the wireline.

3. The combination of claim 2 wherein inhibitor liquid is contained within a vessel, conduit means connecting the vessel to the treatment chamber; means by which pneumatic pressure is contained within the vessel above the liquid level to force inhibitor to flow into said treatment chamber;

said cylinder has an inside surface area that sealingly receives said packers thereagainst, said inside surface area is progressively reduced in diameter in a direction opposed to said lubricator.

4. The combination of claim 3 wherein a pump means has a suction connected to a source of hydraulic fluid and a discharge connected t force hydraulic fluid to flow into the ram chamber and thereby compress the packers.

5. The combination of claim 4 wherein each of the packer devices compress against and thereby wipe residual matter from the wireline, with there being an uppermost packer, a middle packer, and a lowermost packer connected in series, axial aligned relationship.

6. The combination of claim 4 wherein there are three packers, a gate at the upper end of the cylinder whereby a wireline can extend axially through the cylinder, packers, spacers, cones, and gate; and said gate can be removed to enable said packers, spacers, and cones, to be removed from the cylinder while the wireline extends therethrough.

7. Corrosion inhibiting apparatus for cleaning and treating a wireline while running tools suspended from the wireline into and out of a wellbore under pressure to thereby inhibit and reduce corrosion of the wireline, comprising:

a lubricator having a lower end that can be connected to the upper end of the wellbore in axially aligned relationship therewith, an upper cylinder having an upper end adapted to receive a wireline therein that extends along the axial centerline thereof; said cylinder has a plurality of spaced packer devices therein for squeezingly surrounding a length of the wireline and for stripping liquid therefrom; spacer means by which said packer devices are arranged in axially spaced relationship within said cylinder; said packer devices cooperate together to form a high pressure treatment chamber that is isolated from ambient; said chamber being located between some adjacent packer devices; and a cleaning chamber located between some other adjacent packer devices; said cleaning chamber is spaced from said treatment chamber; means connected to said treatment chamber for filling said treatment chamber with treatment fluid; conduit means connected to form a discharge for said cleaning chamber;

ram means reciprocatingly received within the lower end of said cylinder for axial movement in response to pressure differential thereacross, said ram means simultaneously engages and axially compresses each packer device in response to movement of said ram means;

fluid pressure control means connected to actuate said ram means; whereby a wireline can be cleaned and inhibited with treatment fluid as it is run into the wellbore, and can be cleaned and inhibited as it is retrieved from the wellbore.

8. The apparatus of claim 7 wherein said packer devices have opposed conical faces, conical members arranged to abuttingly engage said conical faces, said spacers have opposed ends within which said conical members are seated, whereby the ram means urges the opposed conical members towards one another and thereby compresses the packer devices.

9. The apparatus of claim 8 wherein a vessel containing an inhibitor is connected to said treatment chamber, pneumatic pressure is effected above the liquid level of the inhibitor to force inhibitor to flow into said treatment chamber.

10. The apparatus of claim 9 wherein pump means connects a source of hydraulic fluid to the ram means and thereby actuates the ram means and compresses the packer devices;

said cylinder has an inside surface area that sealingly receives said packers thereagainst, said inside surface area is progressively reduced in diameter in a direction opposed to said lubricator.

11. The apparatus of claim 10 wherein each of the packer devices act to compress against the outer surface of the wireline to wipe residual matter from the wireline, with there being an uppermost packer, a middle packer, and a lowermost packer spaced axially to form said treatment and said cleaning chambers.

12. The apparatus of claim 11 wherein there are three packers, a removable gate at the upper end of said cylinder, and said ram means at the lower end of the cylinder; a wireline can extend through the cylinder and through the packers, spacers, cones, and gate, all of which can be assembled into the cylinder while a wireline extends therethrough.

13. In an apparatus for running tools suspended from a wireline into a wellbore under pressure, and having the lubricator at the lower end thereof that can be connected to and upper end of the wellbore in axially aligned relationship therewith and an upper end in the form of a packer device including a ram assembly by which the packer device is actuated; the improvement comprising:

said upper end includes a cylinder connected to one end of the ram assembly, a plurality of spaced packer devices within said cylinder, each of said plurality of packer devices has a central passageway through which a wireline extends and a radial slit for receiving a wireline within the central passageway, each packer device squeezingly surrounds a length of the wireline and can therefore strip liquid and debris therefrom; spacer means by which said packer devices are arranged in axially spaced relationship within said cylinder; said packer devices and spacers cooperate together to form a high pressure treatment chamber and a cleaning chamber between adjacent packers; said treatment chamber is isolated from ambient and spaced from said cleaning chamber; said cleaning chamber underlies said treatment chamber;

ram means reciprocatingly received within the lower end of said cylinder for axial movement in response to pressure differential placed thereacross, and means for actuating said ram means and thereby engaging and axially compressing each packer device.

14. The improvement of claim 13 wherein said packer devices have opposed conical faces engaged with conical members which have opposed ends within which said conical members are seated whereby the ram means urges the opposed members towards one another and thereby compresses the packer devices therebetween.

15. The improvement of claim 14 wherein inhibitor is contained within a vessel, and pump means by which inhibitor is forced to flow from said vessel into said treatment chamber.

16. The improvement of claim 15 wherein a ram pump means is connected to force hydraulic fluid to flow into a ram chamber and thereby compress the packer devices to sealingly engage the wireline and the interior of the cylinder;

said cylinder has an inside surface area that sealingly receives said packers thereagainst, said inside surface area is progressively reduced in diameter in a direction opposed to said lubricator.

17. The improvement of claim 16 wherein each of said packer devices are arranged to wipe residual matter from the wireline as the wireline passes therethrough, there being an uppermost packer, a middle packer, and a lowermost packer device.

18. The improvement of claim 17 wherein there are three packers that are jointly arranged to be moved by said ram means towards a gate located at the upper end of the cylinder; said ram means is located at the lower end of the cylinder so that a wireline can extend through the gale, cylinder, the packer devices, spacers, cones, and said packer devices, spacers, cones, and gate can be assembled and disassembled while the wireline is contained within the cylinder and lubricator.

19. The improvement of claim 14 wherein said packer devices each have opposed conical faces that are engaged with the conical members; said spacers have opposed ends within which said conical members are seated; whereby, the ram means urges the opposed members towards one another and thereby compresses the packers;

said inhibitor is contained within a vessel, and pneumatic pressure is effected above liquid level to force the inhibitor to flow the inhibitor into the treatment chamber;

said cylinder has an inside surface area that sealingly receives said packers thereagainst, said inside surface area is progressively reduced in diameter in a direction opposed to said lubricator.

20. The improvement of claim 19 wherein there are three packer devices, a gate at the upper end of the cylinder and a ram at the lower end of the cylinder; a wireline can extend through the cylinder, packers, spacers, cones, ram means, and gate;

a pump means connected to flow fluid to the ram means and thereby compress the packers;

each of the packers wipe residual matter from the wireline with there being an uppermost packer, a middle packer, and a lowermost packer spaced apart to form said cleaning and treatment chambers.

* * * * *